US007236607B2

(12) United States Patent
D'Hoogh

(10) Patent No.: US 7,236,607 B2
(45) Date of Patent: Jun. 26, 2007

(54) LOUDSPEAKER WITH A FIRST AND A SECOND DIAPHRAGM BODY

(75) Inventor: Guido Odilon Maurits D'Hoogh, Dendermonde (BE)

(73) Assignee: PSS Belgium, N.V., Dendermonde (BE)

( * ) Notice: Subject to any disclaimer, the term of this patent is extended or adjusted under 35 U.S.C. 154(b) by 217 days.

(21) Appl. No.: 10/511,973

(22) PCT Filed: Apr. 25, 2003

(86) PCT No.: PCT/IB03/01845

§ 371 (c)(1),
(2), (4) Date: Oct. 20, 2004

(87) PCT Pub. No.: WO03/092324

PCT Pub. Date: Nov. 6, 2003

(65) Prior Publication Data

US 2005/0207612 A1 Sep. 22, 2005

(30) Foreign Application Priority Data

Apr. 25, 2002 (EP) ..... 02076651

(51) Int. Cl.
*H04R 25/00* (2006.01)

(52) U.S. Cl. ..... 381/396; 381/398; 381/403

(58) Field of Classification Search ..... 381/396, 381/423–424, 335, 398, 403–405, 407, 412, 381/416, 418, 420, 431; 181/148, 157, 163–165, 181/171–173

See application file for complete search history.

(56) References Cited

U.S. PATENT DOCUMENTS 4,427,846 A * 1/1984 Millward ..... 381/423
5,526,441 A * 6/1996 Codnia et al. ..... 381/430
5,841,880 A * 11/1998 Sakamoto ..... 381/401
6,236,733 B1 * 5/2001 Kato et al. ..... 381/423
6,330,340 B1 * 12/2001 Proni ..... 381/397
6,929,092 B2 * 8/2005 Abe et al. ..... 181/168
6,944,310 B2 * 9/2005 Ito et al. ..... 381/386
6,956,953 B2 * 10/2005 Mazarakis ..... 381/152
7,142,687 B2 * 11/2006 Hanada ..... 381/421

FOREIGN PATENT DOCUMENTS

JP 08205283 A 8/1996

* cited by examiner

*Primary Examiner*—Huyen Le
(74) *Attorney, Agent, or Firm*—Sheehan, Phinney, Bass & Green, PA; Peter A. Nieves

(57) ABSTRACT

A loudspeaker includes a frame, a diaphragm and an electric driving arrangement for moving the diaphragm along an axis with respect to the frame. The diaphragm includes an outer conical first diaphragm body and an inner conical second diaphragm body invertedly oriented with respect to and positioned inside the first diaphragm body. The first and second diaphragm bodies each have a base portion and a top portion, the top portion of the first diaphragm body and the base portion of the second diaphragm body being interconnected. The diaphragm is suspended from the frame by a first flexible suspension member extending between the base portion of the first diaphragm body and the frame, and a second flexible suspension member extending between the top portion of the first diaphragm body and the frame. The top portion of the second diaphragm body is attached to a movable part of the driving arrangement.

6 Claims, 3 Drawing Sheets

LOUDSPEAKER WITH A FIRST AND A SECOND DIAPHRAGM BODY

BACKGROUND OF THE INVENTION

1. Field of the Invention

The invention relates to a loudspeaker provided with a frame, a diaphragm and an electric driving means for moving the diaphragm along an axis of translation with respect to the frame, said diaphragm running round the axis of translation and including an outer conical first diaphragm body and an inner conical second diaphragm body which is invertedly oriented with respect to and positioned inside the first diaphragm body, each body having a base portion and a top portion, the top portion of the first diaphragm body and the base portion of the second diaphragm body being interconnected, and said electric driving means including a stationary part connected to the frame and a movable part.

2. Description of the Related Art

Japanese Patent Publication No. JP-A 0 820 52 83 discloses a loudspeaker having a diaphragm including an outside cone part and an inverted inside cone part coupled in a coupling part to the outside cone part. A voice coil bobbin is joined to the inside cone part. The diaphragm is suspended from a frame by means of a flexible suspension ring fixed to the largest circumferential rim of the outside cone part and the frame and a flexible centering element attached to the frame and a middle portion of the voice coil bobbin. Although due to the applied diaphragm the height of the known loudspeaker may be smaller than the height of generally known loudspeakers provided with single conical diaphragms, this known speaker has still a relatively large height owing to the required relatively long voice coil bobbin.

SUMMARY OF THE INVENTION

It is an object of the invention to improve the loudspeaker as defined in the preamble in such a way that a very small height is within reach.

This object is achieved by the loudspeaker according to the invention, which is provided with a frame, a diaphragm and an electric driving means for moving the diaphragm along an axis of translation with respect to the frame, which diaphragm runs round the axis of translation and includes an outer conical first diaphragm body and an inner conical second diaphragm body which is invertedly oriented with respect to and positioned inside the first diaphragm body, each body having a base portion and a top portion, the top portion of the first diaphragm body and the base portion of the second diaphragm body being interconnected, and which electric driving means includes a stationary part connected to the frame and a movable part, wherein the diaphragm is suspended from the frame through a first flexible suspension means extending between the base portion of the first diaphragm body and the frame and through a second flexible suspension means extending between the top portion of the first diaphragm body and/or the base portion of the second diaphragm body on the one hand and the frame or a mechanical structure fixed to the frame on the other hand and wherein the top portion of the second diaphragm body is attached to the movable part of the driving means. Due to this suspension arrangement, the moving part of the driving means of the loudspeaker can be surprising short, i.e., the axial dimension of the moving part, thus, the dimension considered along the axis of translation, can be small. This means that the required built-in depth is also small. For this reason, the loudspeaker according to the invention is very suitable for applications in which flat devices are desired or required. Such applications can be found, e.g., in the automotive field.

In a practical embodiment, the driving means is positioned opposite to the second diaphragm body and at least partly inside the first diaphragm body. Generally, the stationary part of the driving means, also referred to as electromagnetic actuator, includes a magnetic yoke with a permanent magnet, and the movable part of the driving means includes a driving coil, also referred to as voice coil, for magnetic co-operation with the magnetic yoke. Thus, the driving coil is situated in the magnetic field of the magnet.

A preferred embodiment of the loudspeaker according to the invention, is characterized in that the first flexible suspension means is attached to the first diaphragm body, on the one hand, and the frame or a mounting element fixed to the frame, on the other hand. The first flexible suspension means may be a flexible structure with an undulation or wrinkle. Such a structure may be, for example, a corrugated rubber annular rim.

In general, the second flexible suspension means is a radial bearing means, also referred to as centering means, particularly centering ring or spider. This radial bearing means serves to guarantee an accurate alignment of the diaphragm with respect to the frame, and may be in the form of a flexible structure of, for example, rubber, synthetic material and/or textile.

A further preferred embodiment of the loudspeaker according to the invention, is characterized in that the second flexible suspension means is attached to the first and/or second diaphragm body, on the one hand, and the frame or the mechanical structure fixed to the frame, on the other hand. In this context, it is noted that mechanical structure is a stiff structure which may include a mounting element that may be secured to or include the stationary part of the driving means. Preferably, the mounting element comprises a central support located at the axis of translation of the diaphragm and at least partly positioned inside the diaphragm.

Although the diaphragm can be constituted by two separate diaphragm bodies, it may be favorable, for example, for manufacturing reasons, if the first diaphragm body and the second diaphragm body form an integral diaphragm body. The material of the diaphragm may be conventional pressed paper, injection molded plastics or deep-drawn plastics, such as polycarbonate, polypropylene.

The invention also relates to a loudspeaker unit provided with an enclosure and a built-in loudspeaker according to the invention.

BRIEF DESCRIPTION OF THE DRAWINGS

The above-mentioned and other aspects of the invention are apparent from and will be elucidated, by way of non-limitative example, with reference to the embodiments described hereinafter, and to the accompanying drawings, in which.

DESCRIPTION OF THE PREFERRED EMBODIMENTS

Figure 1:
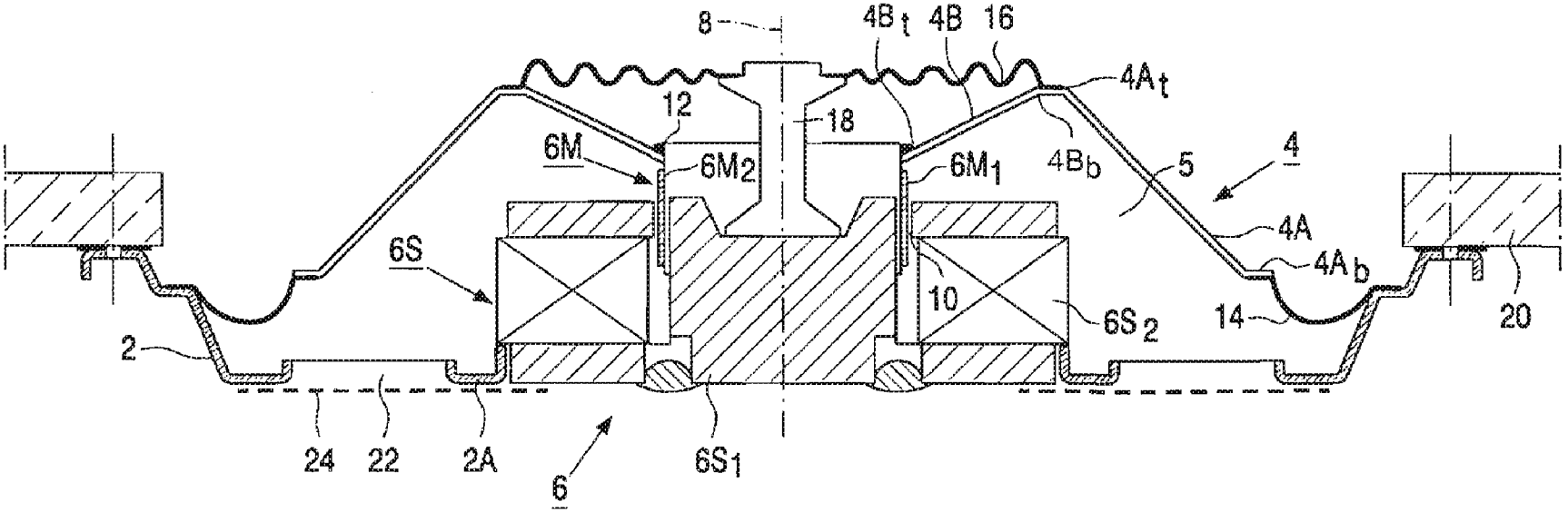
FIG. 1 shows a first embodiment of the loudspeaker according to the invention in a diagrammatic cross-section.

The electrodynamic loudspeaker according to the invention, shown in FIG. 1, includes a frame or chassis 2, a diaphragm 4 and an electromagnetic actuator 6 for moving the diaphragm 4 along an axis of translation 8 with respect to the frame 2. The diaphragm 4 comprises two conical bodies, i.e., an outer conical first diaphragm body 4A and an inner conical second diaphragm body 4B, the first and second diaphragm bodies being invertedly oriented with respect to each other. The first diaphragm body 4A has a base portion 4Ab and a top portion 4At. The second diaphragm body 4B has a base portion 4Bb and a top portion 4Bt, the top portion 4At and the base portion 4Bb being mutually connected. In this example, the conical first and second diaphragm bodies 4A and 4B form an integral whole, i.e., the diaphragm 4, the top portion 4At and the base portion 4Bt coinciding. The actuator 6, which is also referred to as electric driving means in this document, includes a stationary part 6S connected to the frame 2 and a movable part 6M connected to the diaphragm 4. The stationary part 6S, which is fixed to a mounting plate 2A of the frame 2 by means of, e.g., folding, has a magnetic yoke 6S1 and a permanent magnet 6S2. Due to the space 5 created by the diaphragm 4, a relatively large stationary part 6S can be applied, so that not only compact, expensive neodymium magnets, but also conventional and thus cheap magnets of, e.g., ferrite can be used. The movable part 6M, which is translatable along the axis of translation 8 with respect to the stationary part 6S, has a driving coil 6M1, also referred to as voice coil, and a tubular coil support 6M2 supported by the coil 6M1. Upon energization, the driving coil 6M1 magnetically co-operates over an air gap 10 with the magnet 6S2. The coil support 6M2 has an end portion 12 which is situated outside the air gap 10. The top portion 4Bt of the second diaphragm body 4B is attached to this end portion 12 by means of, e.g., an adhesive. The diagram 4 is suspended from the frame 2 by means of a flexible corrugated annular rim 14 of, e.g., rubber, this annular rim being also referred to in this document as first flexible suspension means. The annular rim 14 is attached to the base portion 4Ab of the first diaphragm body 4A, e.g., by means of an adhesive, and is further fixed to the frame 2. An undulating centering spider 16, also referred to as second flexible suspension means in this document, is provided in or near the plane defined by the top portion 4At of the first diaphragm body 4A and the base portion 4Bb of the second diaphragm body 4B. The centering spider 16 is attached to the diaphragm 4, at the location of the top portion 4At and the base portion 4Bb, by means of, e.g., an adhesive. The centering spider 16 is further fixed to a central mounting element 18. This mounting element 18 is fixed to the magnetic yoke 6S1 and, via this magnetic yoke 6S1, is secured to the frame 2. Thus, the mounting element 18 and the magnetic yoke 6S1 together form a stiff mechanical structure fixed to the frame 2. The frame 2 may be secured to a wall 20 of a loudspeaker box or a built-in opening.

From FIG. 1, it will be clear that the backside of the loudspeaker according to the invention is formed by the second flexible suspension means. The front side of the loudspeaker may be provided with sound apertures 22, which may be covered by a grid 24, a piece of fabric or something like that.

Figure 2:
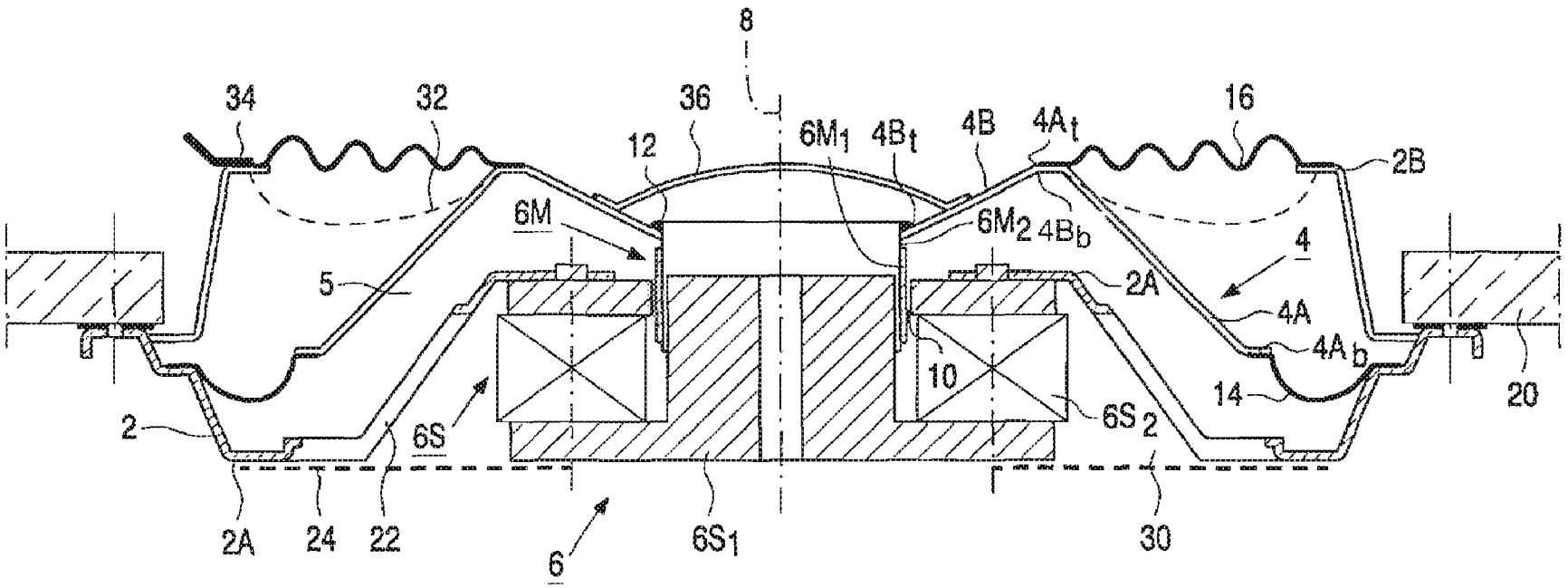
FIG. 2 shows a second embodiment of the loudspeaker according to the invention in a diagrammatic cross-section.
Figure 3:
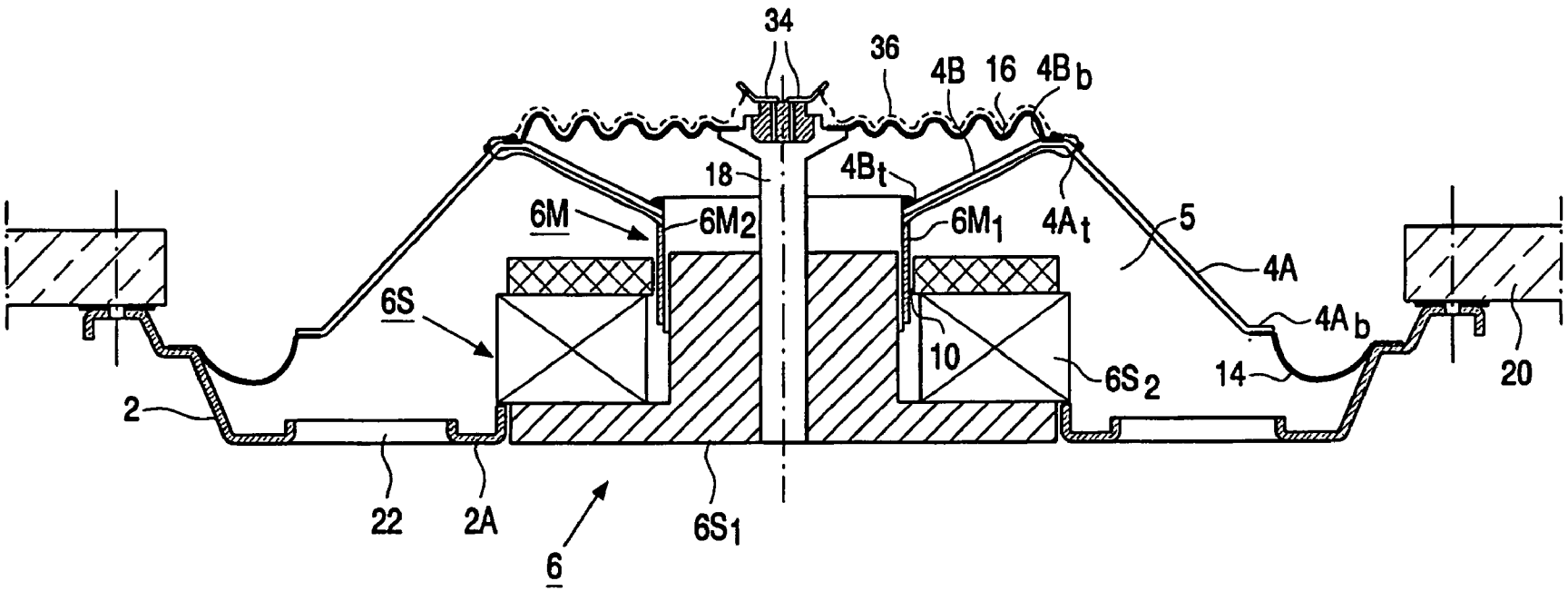
FIG. 3 shows a third embodiment of the loudspeaker according to the invention in a diagrammatic cross-section.

Reference is now made to FIGS. 2 and 3. The features of the embodiments of these Figures which are identical to the corresponding features of the embodiment of FIG. 1 are allocated the same reference numerals and will not be further described in detail.

In the loudspeaker according to the invention shown in FIG. 2, the frame 2 is provided with a concave mounting plate 2A to which the stationary part 6S of the actuator 6 is secured. This alternative construction provides a space 30 in which the stationary part 6S of different types can be accommodated, without the necessary to adapt other parts of the loudspeaker. The centering spider 16 extends between the top portion 4At (or the base portion 4Bb) and a frame 2B of the frame 2 and is fixed to the portion 4At (or 4Bb) and the frame part 2B. Electric wires 32 are led along the second conical diaphragm body 4B and fixed to electric contact elements 34 which are insulated from and secured to the frame 2. A dust cap 36 is provided for acoustical reasons and for protecting the air gap 10 against unwanted particles.

The loudspeaker shown in FIG. 3 is provided with electric contact lips 34 attached to the central mounting element 18. The mounting element 18 is mounted in the magnetic yoke 6S1 and, via the stationary part 6S, is secured to the frame 2. Flexible current conductors 36, which are integrated in the undulating structure of the centering spider 16, are soldered to the lips 34 and the driving coil 6M1. These integrated conductors 36 are rather insensible to damages.

It is to be noted that the invention is not restricted to the embodiments disclosed. For example, the diaphragm 4 may be made from two separate conical bodies 4A and 4B which are joined together during manufacture in such a way that their portions 4At and 4Bb are fastened to each other, e.g., by means of a glue.

The invention claimed is:

1. A loudspeaker comprising:

a frame;

a diaphragm comprising an outer conical first diaphragm body and an inner conical second diaphragm body, said first and second diaphragm bodies each having a base portion and a top portion, the top portion of the first diaphragm body and the base portion of the second diaphragm body being interconnected;

electric driving means for moving the diaphragm along an axis of translation with respect to the frame, said diaphragm running round the axis of translation, said electric driving means including a stationary part connected to the frame, and a movable part attached to the top portion of the second diaphragm body; and suspension means for suspending the diaphragm from the frame, said suspension means including first flexible suspension means coupling the base portion of the first diaphragm body to the frame, and second flexible suspension means coupling the top portion of the first diaphragm body and/or the base portion of the second diaphragm body to the frame, wherein the loudspeaker further comprises:

a mechanical structure fixed to the frame, the second flexible suspension means being attached between the top portion of the first diaphragm body and/or the base portion of the second diaphragm body and the mechanical structure, the mechanical structure including a mounting element secured to the stationary part of the electric driving means, and the mounting element comprising a central support located at the axis of translation of the diaphragm and at least partly positioned inside the diaphragm.

2. The loudspeaker as claimed in claim 1, wherein the electric driving means is positioned opposite to the second diaphragm body and at least partly inside the first diaphragm body.

3. The loudspeaker as claimed in claim 1, wherein the stationary part of the electric driving means includes a magnetic yoke with a permanent magnet, and the movable part of the electric driving means includes a driving coil for an electro-magnetic cooperation with the magnetic yoke.

4. The loudspeaker as claimed in claim 1, wherein the second flexible suspension means is a radial bearing means.

5. The loudspeaker as claimed in claim 1, wherein the first diaphragm body and the second diaphragm body form an integral diaphragm body.

6. A loudspeaker unit provided with an enclosure and a built-in loudspeaker, wherein said built-in loudspeaker comprises:

a frame;

a diaphragm comprising an outer conical first diaphragm body and an inner conical second diaphragm body, said first and second diaphragm bodies each having a base portion and a top portion, the top portion of the first diaphragm body and the base portion of the second diaphragm body being interconnected;

electric driving means for moving the diaphragm along an axis of translation with respect to the frame, said diaphragm running round the axis of translation, said electric driving means including a stationary part connected to the frame, and a movable part attached to the top portion of the second diaphragm body; and suspension means for suspending the diaphragm from the frame, said suspension means including first flexible suspension means coupling the base portion of the first diaphragm body to the frame, and second flexible suspension means coupling the top portion of the first diaphragm body and/or the base portion of the second diaphragm body to the frame, wherein the loudspeaker further comprises:

a mechanical structure fixed to the frame, the second flexible suspension means being attached between the top portion of the first diaphragm body and/or the base portion of the second diaphragm body and the mechanical structure, the mechanical structure including a mounting element secured to the stationary part of the electric driving means, and the mounting element comprising a central support located at the axis of translation of the diaphragm and at least partly positioned inside the diaphragm.

* * * * *